US008982010B2

(12) United States Patent
Umerski

(10) Patent No.: US 8,982,010 B2
(45) Date of Patent: Mar. 17, 2015

(54) ANTENNA CONFIGURATION FOR EMITTING MICROWAVE PULSES

(75) Inventor: Adam Umerski, Nürnberg (DE)

(73) Assignee: Diehl BGT Defence GmbH & Co. KG, Ueberlingen/BRD (DE)

( * ) Notice: Subject to any disclaimer, the term of this patent is extended or adjusted under 35 U.S.C. 154(b) by 247 days.

(21) Appl. No.: 13/544,046

(22) Filed: Jul. 9, 2012

(65) Prior Publication Data

US 2013/0009850 A1 Jan. 10, 2013

(30) Foreign Application Priority Data

Jul. 9, 2011 (DE) ..... 10 2011 107 036

(51) Int. Cl.

| | |
|---|---|
| ***H01Q 1/00*** | (2006.01) |
| ***H01Q 5/00*** | (2006.01) |
| ***F41H 13/00*** | (2006.01) |
| ***H01Q 9/00*** | (2006.01) |
| ***H01Q 19/10*** | (2006.01) |
| ***H01Q 21/00*** | (2006.01) |
| ***H01Q 21/06*** | (2006.01) |

(52) U.S. Cl.

CPC ..... *H01Q 5/0017* (2013.01); *F41H 13/0068* (2013.01); *F41H 13/0093* (2013.01); *H01Q 9/005* (2013.01); *H01Q 19/10* (2013.01); *H01Q 21/0031* (2013.01); *H01Q 21/062* (2013.01)

USPC ..... 343/904; 343/793; 343/755; 327/181

(58) Field of Classification Search

USPC ..... 343/793, 725, 727, 904, 755

See application file for complete search history.

(56) References Cited

U.S. PATENT DOCUMENTS

| | | | | |
|---|---|---|---|---|
| 3,748,528 | A | 7/1973 | Cronson | |
| 5,774,091 | A | 6/1998 | McEwan | |
| 6,597,309 | B1 | 7/2003 | Panton et al. | |
| 8,576,109 | B2 * | 11/2013 | Stark et al. | 342/14 |
| 2004/0190214 | A1 | 9/2004 | Dommer et al. | |
| 2005/0285447 | A1 | 12/2005 | Mayes et al. | |
| 2011/0309870 | A1 | 12/2011 | Stark et al. | |

FOREIGN PATENT DOCUMENTS

| | | | |
|---|---|---|---|
| DE | 103 13 286 | B3 | 1/2005 |
| DE | 102006014230 | A1 | 10/2007 |
| DE | 10 2010 024 214 | A1 | 12/2011 |
| EP | 2397809 | A2 | 12/2011 |
| WO | 9836490 | A1 | 8/1998 |
| WO | 2007112850 | A1 | 10/2007 |

* cited by examiner

*Primary Examiner* — Dieu H Duong

(74) *Attorney, Agent, or Firm* — Laurence A. Greenberg; Werner H. Stemer; Ralph E. Locher

(57) ABSTRACT

An antenna configuration for emitting high-energy microwave pulses has a first flat electrode and a second flat electrode, the first electrode and the second electrode being able to be connected to a generator for producing an excitation pulse. The antenna configuration further has a multiplicity of radiation elements which connect the first electrode and the second electrode to one another, and semiconductor diodes which are provided in the region of the radiation elements and turn on as of a particular breakdown voltage and thus make it possible for the antenna to emit a pulsed overall pulse.

15 Claims, 7 Drawing Sheets

ANTENNA CONFIGURATION FOR EMITTING MICROWAVE PULSES

CROSS-REFERENCE TO RELATED APPLICATION

This application claims the priority, under 35 U.S.C. §119, of German application DE 10 2011 107 036.6, filed Jul. 9, 2011; the prior application is herewith incorporated by reference in its entirety.

BACKGROUND OF THE INVENTION

Field of the Invention

The present invention relates to an antenna configuration for emitting high-energy microwave pulses.

High-energy-density microwave pulses, in particular those based on high power electromagnetics (HPEM) technology, are used nowadays to destroy electronic components in objects which represent a threat, for example those of explosive charges which are fired on a time basis or are controlled by mobile telephones, for example explosive traps or the like, or at least to render them inoperable. Corresponding systems which generate microwave pulses are preferably used in the form of portable systems or are carried on vehicles. They should therefore be as compact as possible. However, the capability to use such systems is not only restricted to the short-range area, but can also be extended over longer ranges, for example with the aim of adversely affecting the flight path of electronically controlled objects, such as rockets or the like. The aim for the described operational capabilities is to produce pulses with as high an energy density and power as possible. However, HPEM sources have the disadvantage that the switching operation is dependent on a spark flashover. This in turn results in the disadvantage that the emission time cannot be reproduced with sufficient accuracy. It is therefore difficult to construct the source array. On account of the abovementioned switching operation, HPEM sources are thereby subject to an increased mechanical load and therefore have a comparatively limited service life. In addition, it is necessary to provide an excitation signal having the shortest possible rise time for HPEM sources, which is subject to a device-related restriction.

U.S. Pat. No. 3,748,528 discloses a microwave pulse generator in which a pulse with an edge rise of the order of magnitude of one nanosecond and an amplitude in the range of 12-20 kV is produced at a first spark gap. This pulse is then converted via a further, series-connected spark gap, which acts as a switch, into a damped sinusoidal oscillation (DS pulse) and is emitted via a reflector and an antenna.

In order to increase the energy density of such pulses, a change has additionally been made to the provision of configurations containing a plurality of parallel-connected microwave generators, as disclosed in published, non-prosecuted German patent application DE 10 2006 014 230 A1 or in German patent DE 103 13 286 B3, corresponding to U.S. Pat. No. 7,233,084. However, such configurations have the disadvantage that they require a certain amount of space, and are therefore suitable only to a limited extent for configurations with reduced dimensions.

SUMMARY OF THE INVENTION

The object of the present invention is to provide a novel antenna configuration which allows pulsed signals with improved properties to be emitted.

The above object is achieved by an antenna configuration which is characterized by a first flat electrode, a second flat electrode, the first electrode and the second electrode being able to be connected to a generator for producing an excitation pulse, a multiplicity of non-linear radiation elements which connect the first electrode and the second electrode to one another, and semiconductor diodes which are provided in the region of the non-linear radiation elements and turn on as of a particular breakdown voltage and thus make it possible for the antenna to emit a pulsed overall pulse. The novel antenna configuration ensures high reproducibility of the emitted pulsed signals (pulses) and the emission time since the switching operation is not established by a spark gap but rather by a semiconductor, namely by the semiconductor diode. This in turn results in considerably lower losses and a considerably longer service life. The novel antenna configuration also makes it possible to use slower pulse generators, pulsed signals having higher frequencies (>300 MHz) than before (a maximum of 50 MHz) being able to be simultaneously emitted. For example, pulsed signals having frequencies of >300 MHz can be emitted during excitation with slow rise times of approximately 10 ns.

The first flat electrode and the second flat electrode are expediently conductive plates, preferably metal plates, with the result that the antenna configuration forms a plate capacitor containing a multiplicity of radiation elements which are distributed over the area of the plates and are in the form of dipoles.

The supply line in the form of a plate capacitor as part of the antenna configuration enables a three-dimensional configuration of the radiation elements depending on the desired use. In particular, this also increases the emitted field. The emission direction of the antenna device can be influenced depending on the location of the supply line.

The radiation elements expediently contain two elongate conductive elements, for example metal strips, which are connected to one another via the semiconductor diode.

As a result of the fact that the radiation elements are fed at the respective electrode via inductances, the efficiency of the antenna configuration is increased to a particular extent.

The semiconductor diodes accommodated in the radiation elements expediently have a so-called "avalanche breakdown characteristic". These are semiconductor diodes with very fast fall times in the reverse direction. A voltage is applied to the diodes via the supply line and the two inductances. The diodes turn on as of a certain breakdown voltage and a pulsed signal is emitted. The emitted frequency is independent of the rise time of the excitation signal. For this reason, there is no need for a generator with a fast rise time in the novel antenna configuration. Nevertheless, switching times in the range of below 500 ps can be achieved.

The antenna configuration according to the invention ensures large degrees of freedom with regard to its application and use. For example, a plurality of radiation sources may be respectively arranged in series behind one another between the flat electrodes or plates, with the result that the distance between the electrodes or plates is approximately twice as long as the dipole length of each radiation element in the case of two radiation elements, for example.

Alternatively, it is also possible to provide a distance which is shorter than the length of the respective radiation element or the dipole length. In this case, cutouts, through which the radiation elements project, are arranged in the electrodes. In this case, the distance between the two electrodes or plates is shorter than the length of the radiation element, that is to say the dipole length. Changing the distance changes the capacitance, with the result that the energy of the generator can be adapted to the antenna configuration by adapting the distance.

The novel antenna configuration makes it possible to use comparatively slow generators to produce an emitted pulsed signal having a high frequency, for example having frequencies of >200 MHz, preferably >250 MHz, particularly preferably >300 MHz.

The rise times of the excitation signal from the generator may preferably be ≥1 ns, particularly preferably ≥5 ns.

In order to increase the efficiency of the emitted pulsed signal, the antenna configuration according to the invention can be combined in a simple manner with at least one passive reflector.

Depending on the intended purpose, a reflector may be arranged to the side of the configuration of the multiplicity of individual radiation elements and electrodes, thus establishing a targeted propagation direction of the pulsed signal, that is to say optimization of the signal in the desired direction.

Alternatively, a reflector may also pass through the configuration of the individual radiation elements and the electrodes or plates, thus resulting in a propagation direction of the pulsed signal in two directions, for example.

If a propagation direction on all sides is intended, a plurality of reflectors may also be provided. For example, a reflector cross may be formed, in which the individual radiation elements are arranged in such a manner that they run substantially concentrically around the crossing point of the reflectors.

Other features which are considered as characteristic for the invention are set forth in the appended claims.

Although the invention is illustrated and described herein as embodied in an antenna configuration for emitting microwave pulses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
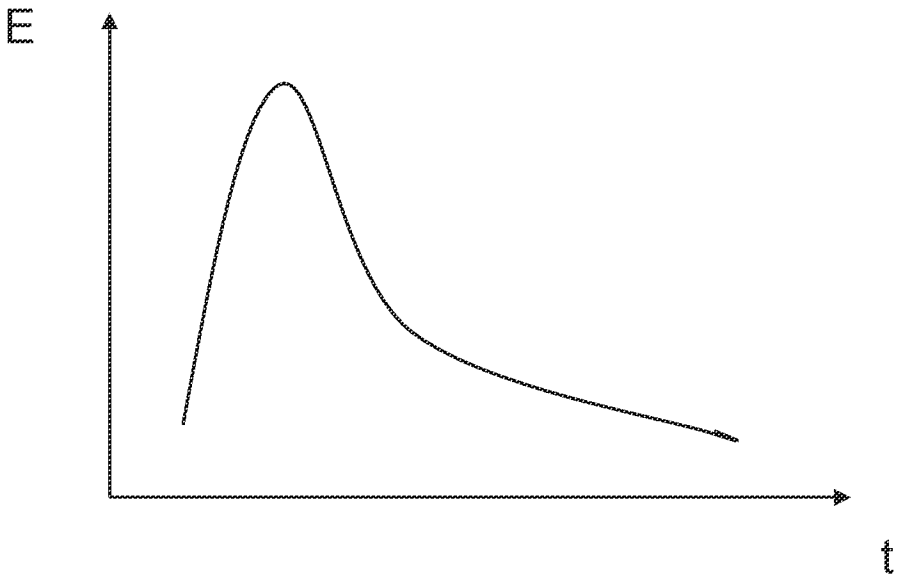
FIG. 1 is a graph illustrating a pulse shape of a pulse directly produced by a pulse generator.

Referring now to the figures of the drawing in detail and first, particularly, to FIG. 1 thereof, there is shown a shape of a typical excitation signal from a generator. The excitation signal has a short rise time in the nanosecond range, for example a rise time of 10 ns, before the signal reaches its peak. The amplitude is of the order of magnitude of usually around 150-200 KV. The frequency of such a pulsed signal is in the MHz range. The higher the frequency, the more energy the pulsed signal has. The frequency of the signal to be emitted is usually higher, the higher the rise time of the excitation signal.

Figure 2:
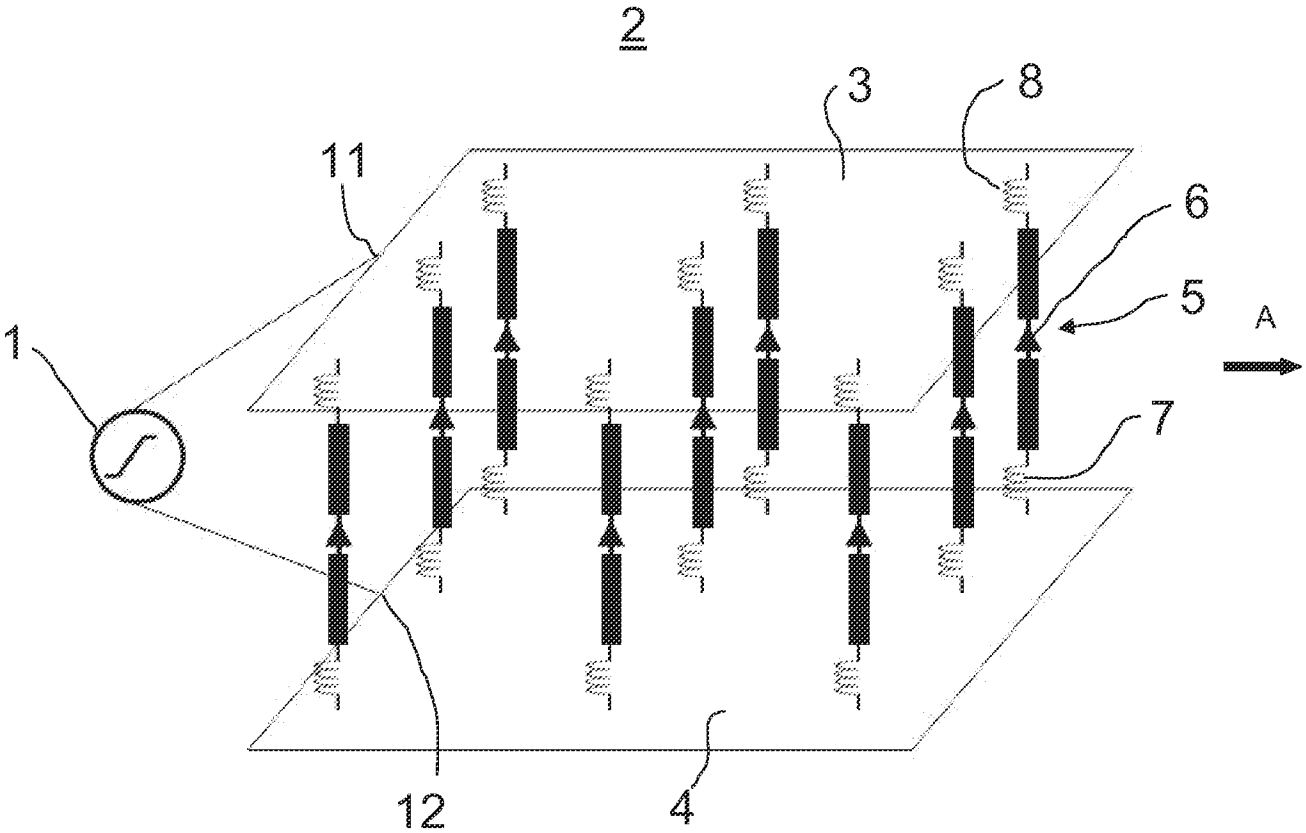
FIG. 2 is a simplified illustration of a first refinement of an antenna configuration according to the invention.

FIG. 2 shows a highly simplified schematic illustration of a first refinement of an antenna configuration 2 according to the invention. The antenna configuration 2 contains a first flat electrode 3 and a second flat electrode 4, for example in the form of flat conductive plates, for example metal plates, which are arranged at a particular distance from one another and form a plate capacitor. Each electrode 3, 4 has a feed point 11 and 12 for feeding in the pulsed signal from a generator 1, approximately in the center of the left-hand side edge of the electrode 3 or 4 in this case. The generator 1 may be a generator with a comparatively "short" rise time, for example of >1 ns.

A multiplicity of dipole-like non-linear radiation elements 5 which are connected in parallel and connect the two electrodes 3, 4 to one another are situated between the two electrodes 3, 4. A pulsed signal fed in via the feed points 11, 12 is fed into all radiation elements 5.

The radiation elements 5 are elongate conductive elements, for example metal strips made of Cu or Al, which are each connected to one another via a semiconductor diode 6. The pulsed signal from the generator 1 is fed, via the respective electrode 3, 4, into the respective radiation element 5 via inductances 7 and 8. The use of the inductances 7, 8 improves the emission time of the pulse to be emitted by the antenna device 2 and makes it possible to increase the pulse sharpness while simultaneously increasing the pulse intensity.

The semiconductor diode 6 is expediently a semiconductor diode with a so-called avalanche breakdown characteristic, that is to say a semiconductor diode which is installed with a fast fall time in the reverse direction. A voltage is applied to the respective semiconductor diode 6 via the supply line and the two inductances 7, 8. The semiconductor diode turns on as of a certain breakdown voltage and a pulsed signal is emitted by the respective radiation element 5. The sum of the individual signals produced at the same time by the radiation elements 5 results in the overall pulse emitted by the antenna configuration. This overall pulse is emitted in the direction A with the single-ended feeding in FIG. 2.

In the normal case, the emitted frequency f depends on the rise time t as follows:

$$f<1/(2\times t).$$

On account of the special feeding of the antenna configuration and the switching operation by the semiconductor diode, it is advantageously possible to dispense with a generator with a fast rise time. This is because the emitted frequency is independent of the rise time of the excitation signal in the present case. In addition, the antenna configuration makes it possible to use slow pulse generators with a rise time of approximately 10 ns to emit pulsed signals having high frequencies of more than 200 MHz, preferably more than 250 MHz, particularly preferably more than 300 MHz.

The radiation elements 5 are dipoles. The number and configuration in the antenna configuration depend on the specific use. The distance between the electrodes 3, 4, that is to say the plates, can likewise be changed in any desired manner, depending on the use, impedance matching and emission characteristic.

Figure 3:
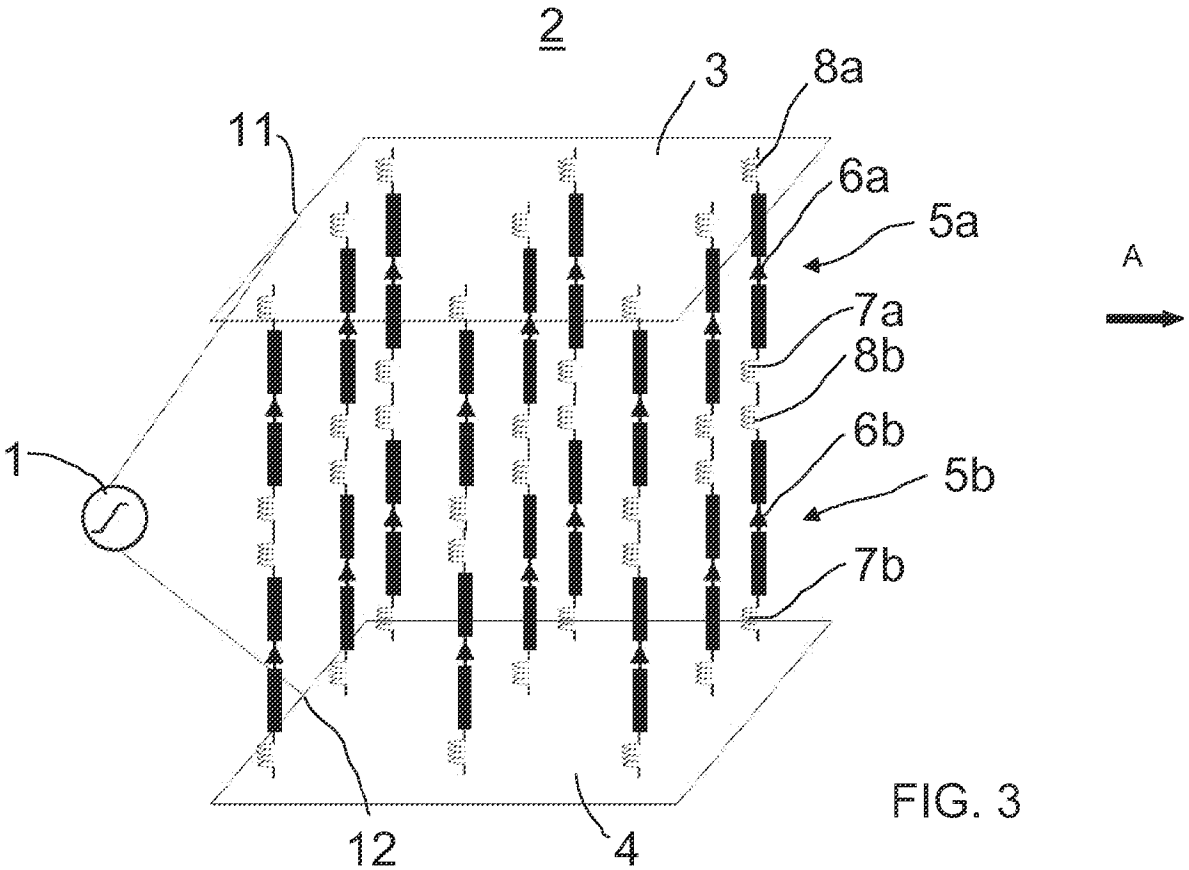
FIG. 3 is an illustration of a further embodiment of the antenna configuration according to the invention.

FIG. 3 shows a further refinement of the antenna configuration according to the invention in which the distance between the electrodes 3, 4 is increased in comparison with the dipole length, that is to say the length of the individual radiation element. This is effected by virtue of a plurality of radiation elements 5*a*, 5*b* being located between the electrodes 3, 4 in a manner connected in series. The excitation signal is likewise fed in via inductances 7*a*, 7*b* and 8*a*, 8*b* provided on both sides of the radiation element 5*a*, 5*b*. In the case of the refinement according to FIG. 3, two radiation elements 5*a* and 5*b* are connected in series. However, even more radiation elements may also be connected in series. This antenna configuration also emits in a direction A on account of the fact that the excitation signal from the generator 1 is laterally fed to the two electrodes 3, 4.

Figure 4:
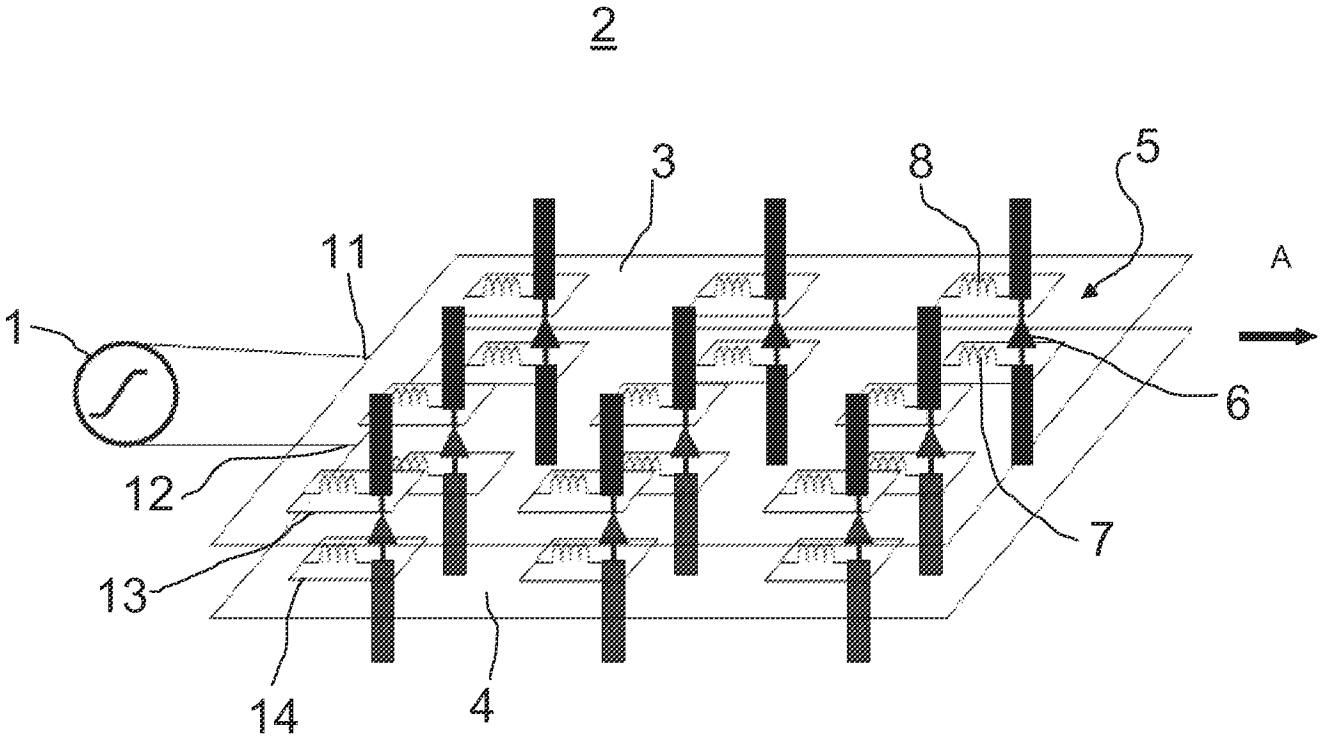
FIG. 4 is an illustration showing a further refinement of the antenna configuration according to the invention.

Depending on the application, it is also possible for the distance between the electrodes 3, 4 to be shorter than the dipole length or length of the radiation element 5 (FIG. 4). In this case, cutouts 13 and 14 are provided in the respective electrodes 3, 4, with the result that the radiation elements 5 pass through the electrodes 3 and 4. In this case too, the excitation signal is fed in via the inductances 7 and 8 which make contact with the electrodes 3, 4 in the region of the cutouts 13, 14 and make contact with the radiation element 5 at the radiation element 5 on both sides of the semiconductor diode 6. Changing the distance changes the capacitance of the plate capacitor, with the result that the energy of the generator can be adapted to the antenna configuration by adapting the distance. The emission direction is indicated by the arrow A.

Figure 5B:
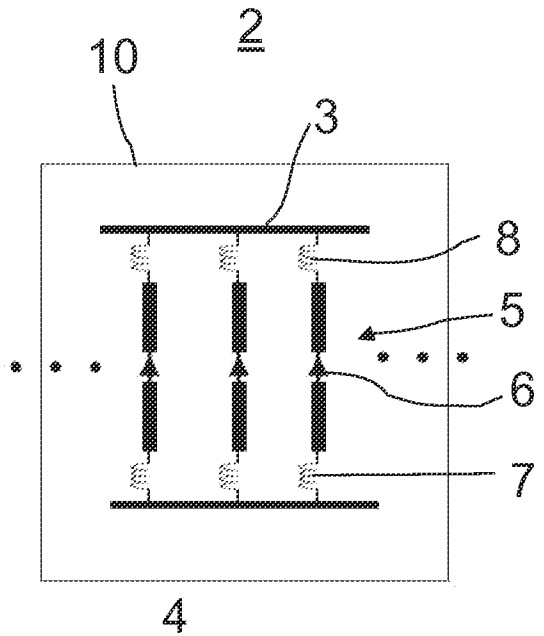
FIG. 5B is an illustration of antenna showing a plan view of the reflector.
Figure 5A:
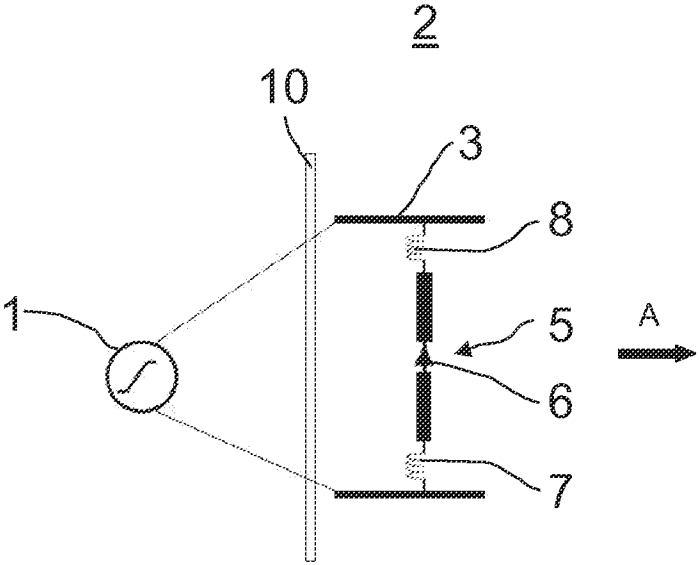
FIG. 5A is an illustration of the antenna configuration according to the invention using a laterally arranged passive reflector, showing a side view of the reflector.

The configuration according to the invention can also be combined with a passive reflector 10 in order to influence the emission direction, that is to say propagation direction A, of the pulse to be produced. In the refinement according to FIGS. 5A, 5B, the reflector 10 is to the side of the configuration of the individual radiation elements 5, thus resulting in a propagation direction of the produced pulse in the direction A according to FIG. 5A. As emerges from FIG. 5B, the reflector 10 completely covers the configuration of the individual radiation elements 5.

Figure 6B:
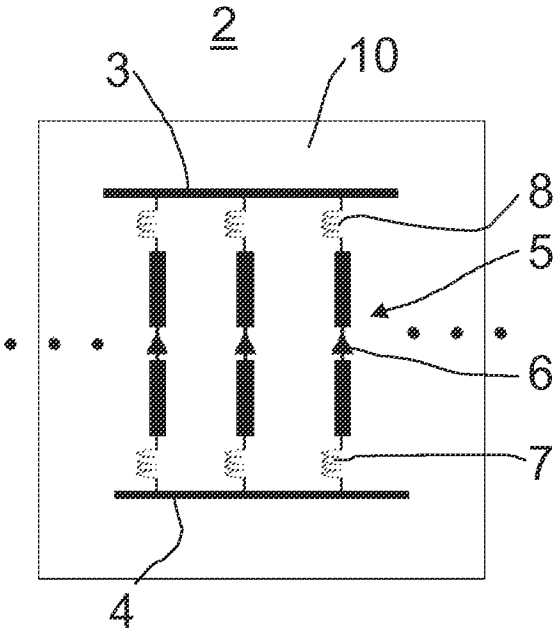
FIG. 6B is an illustration of the antenna configuration and in a plan view of the reflector.
Figure 6A:
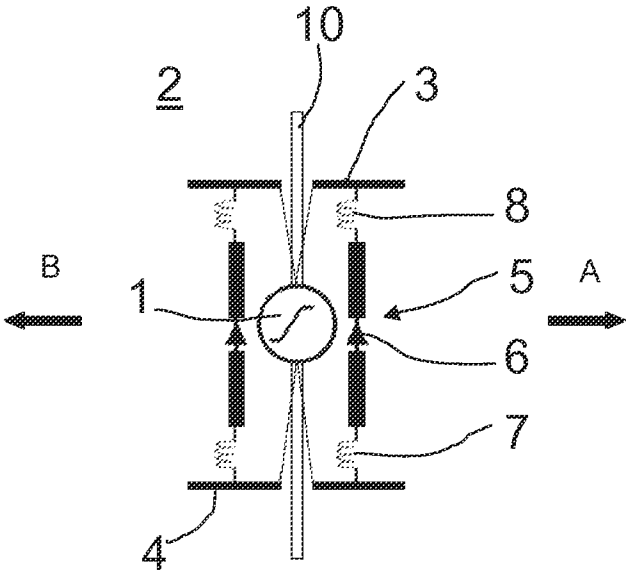
FIG. 6A is an illustration of the antenna configuration according to the invention having the passive reflector passing through the antenna configuration and is intended for emission on both sides, showing a side view of the reflector.

In order to allow the pulse to be emitted to propagate in two directions, the passive reflector may also pass through the configuration of the individual radiation elements 5 and electrodes 3, 4 according to FIGS. 6A, 6B. Consequently, the emitted pulse propagates both in the direction A and in the direction B, as is clear from FIG. 6A.

In this case too, the reflector 10 covers the entire configuration of the individual radiation elements 5, as is clear from FIG. 6B.

Figure 7B:
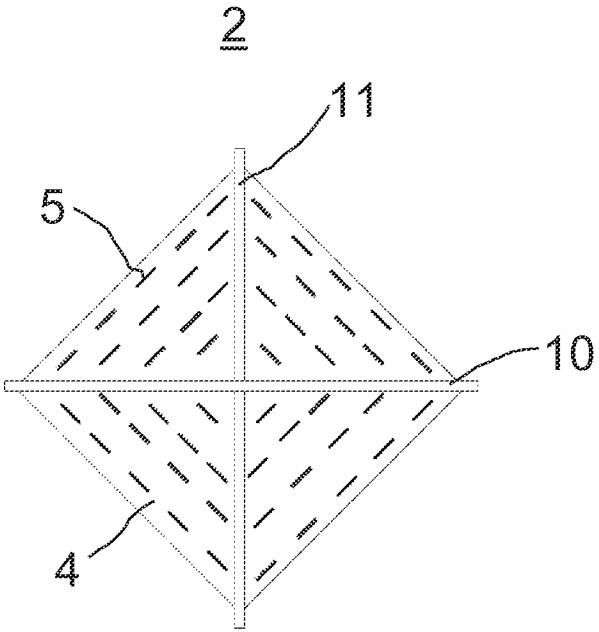
FIG. 7B is a plan view of a top side of the antenna configuration according to FIG. 7A with an omission of an upper electrode.
Figure 7A:
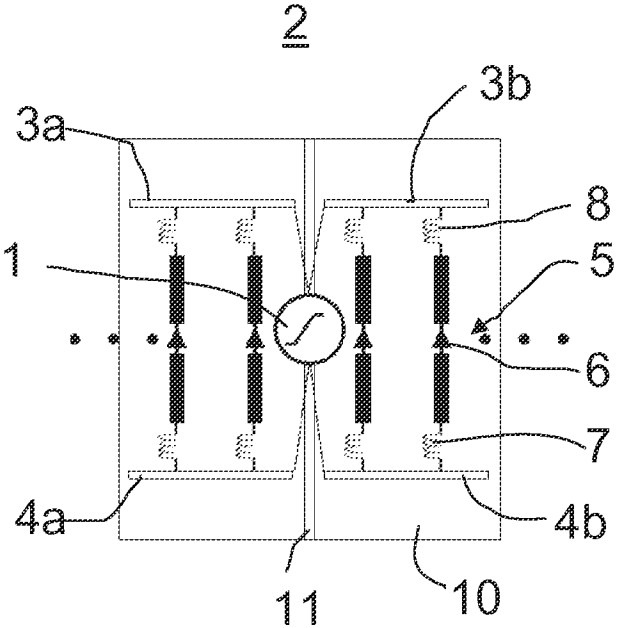
FIG. 7A is an illustration of the antenna configuration according to the invention using two crossing reflectors for emission on all sides, in a side view of one reflector.

Finally, FIGS. 7A, 7B shows an configuration in which the pulse to be emitted by the antenna configuration is intended to be emitted on all sides. For this purpose, two reflectors 10, 11 are arranged in the form of a cross with respect to one another, the individual radiation elements 5 being located in different rows in a manner such that they run concentrically around the crossing point of the reflectors 10, 11. This is particularly clear from FIG. 7B in which the upper electrode 3 is not illustrated for the sake of clarity. The respective electrode 3 or 4 is divided into two electrodes 3*a*, 3*b* or 4*a*, 4*b* in each case. The generator 1 directly acts on each of the electrodes 3*a* and 3*b* or 4*a* and 4*b*, as illustrated in FIG. 7A.

The new antenna configuration makes it possible to emit microwave pulses with a very high energy density and sharpness without having to use excitation signals with a very high rise time. On account of the good reproducibility of the switching time, arrays comprising individual radiation elements in any desired configuration and of any desired size can be produced. The invention is therefore a very significant contribution in the relevant field of technology.

The invention claimed is:

1. An antenna configuration for emitting high-energy microwave pulses, comprising:

electrodes including a first flat electrode and a second flat electrode, said first flat electrode and said second flat electrode being able to be connected to a generator producing an excitation signal;

a multiplicity of radiation elements connecting said first flat electrode and said second flat electrode to one another;

inductances, said radiation elements being fed by a respective one of said first and second flat electrodes via said inductances; and semiconductor diodes disposed in a region of said radiation elements and turn on as of a particular breakdown voltage and thus make it possible for the antenna configuration to emit a pulsed overall pulse being an emitted overall signal.

2. The antenna configuration according to claim 1, wherein said first flat electrode and said second flat electrode are conductive plates.

3. The antenna configuration according to claim 1, wherein said semiconductor diodes have an avalanche breakdown characteristic.

4. The antenna configuration according to claim 1, wherein at least two of said radiation elements are disposed behind one another.

5. The antenna configuration according to claim 1, wherein a distance between said first and second electrodes is shorter than a length of said radiation element.

6. The antenna configuration according to claim 1, wherein a frequency of the emitted overall signal from the antenna configuration is independent of a rise time of the excitation signal of the antenna configuration.

7. The antenna configuration according to claim 1, wherein the emitted pulsed signal has a frequency of >200 MHz.

8. The antenna configuration according to claim 1, wherein a rise time of the excitation signal is ≥1 ns.

9. The antenna configuration according to claim 1, wherein a rise time of the excitation signal is ≥5 ns.

10. The antenna configuration according to claim 1, wherein the emitted pulsed signal has a frequency of >250 MHz.

11. The antenna configuration according to claim 1, wherein the emitted pulsed signal has a frequency of >300 MHz.

12. An antenna configuration for emitting high-energy microwave pulses, comprising:

electrodes including a first flat electrode and a second flat electrode, said first flat electrode and said second flat electrode being able to be connected to a generator producing an excitation signal;

a multiplicity of radiation elements connecting said first flat electrode and said second flat electrode to one another;

semiconductor diodes disposed in a region of said radiation elements and turn on as of a particular breakdown voltage and thus make it possible for the antenna configuration to emit a pulsed overall pulse being an emitted overall signal; and at least one passive reflector.

13. The antenna configuration according to claim 12, wherein said at least one passive reflector is disposed to a side of a configuration of said radiation elements.

14. The antenna configuration according to claim 12, wherein said at least one passive reflector passes through a configuration of said radiation elements.

15. The antenna configuration according to claim 14, wherein said at least one passive reflector is one of at least two crossing reflectors, and individual ones of said radiation elements are disposed in such a manner that they run substantially concentrically with respect to a crossing point of said crossing reflectors.

* * * * *